US009865204B2

(12) United States Patent
Liu et al.

(10) Patent No.: US 9,865,204 B2
(45) Date of Patent: Jan. 9, 2018

(54) CIRCUIT AND METHOD FOR ELIMINATING SHUTDOWN AFTER-IMAGE, AND DISPLAY DEVICE

(71) Applicants: BOE TECHNOLOGY GROUP CO., LTD., Beijing (CN); HEFEI BOE OPTOELECTRONICS TECHNOLOGY CO., LTD., Hefei, Anhui (CN)

(72) Inventors: Rongcheng Liu, Beijing (CN); Douqing Zhang, Beijing (CN); Hengzhen Liang, Beijing (CN)

(73) Assignees: BOE TECHNOLOGY GROUP CO., LTD., Beijing (CN); HEFEI BOE OPTOELECTRONICS TECHNOLOGY., LTD., Anhui (CN)

( * ) Notice: Subject to any disclaimer, the term of this patent is extended or adjusted under 35 U.S.C. 154(b) by 101 days.

(21) Appl. No.: 14/362,071

(22) PCT Filed: Sep. 13, 2013

(86) PCT No.: PCT/CN2013/083450

§ 371 (c)(1),
(2) Date: May 30, 2014

(87) PCT Pub. No.: WO2015/010360

PCT Pub. Date: Jan. 29, 2015

(65) Prior Publication Data

US 2015/0042548 A1 Feb. 12, 2015

(30) Foreign Application Priority Data

Jul. 23, 2013 (CN) ..... 2013 1 0311496

(51) Int. Cl.
*G09G 3/36* (2006.01)

(52) U.S. Cl.
CPC ..... *G09G 3/3611* (2013.01); *G09G 3/3677* (2013.01); *G09G 2310/063* (2013.01);
(Continued)

(58) Field of Classification Search
CPC .. G09G 3/3611; G09G 2310/063; G09G 3/36; G09G 3/38
See application file for complete search history.

(56) References Cited

U.S. PATENT DOCUMENTS

2008/0042952 A1 2/2008 Fu
2008/0143662 A1* 6/2008 Hong ..... G09G 3/3677 345/92

(Continued)

FOREIGN PATENT DOCUMENTS

CN 1690324 A 11/2005
CN 101046940 A 10/2007

(Continued)

OTHER PUBLICATIONS

International Search Report and Written Opinion dated May 16, 2014 regarding PCT/CN2013/083450. Translation provided by Dragon Intellectual Property Law Firm.

(Continued)

*Primary Examiner* — Tony N Ngo
(74) *Attorney, Agent, or Firm* — Harness, Dickey & Pierce, P.L.C.

(57) ABSTRACT

The present invention relates to the field of display technology, and provides a circuit and a method for eliminating a shutdown after-image, and a display device. The circuit for eliminating the shutdown after-image in a liquid crystal panel comprises a control module configured to apply a common voltage of a liquid crystal panel to a gate line of the liquid crystal panel under the control of a shutdown signal when the liquid crystal panel is shut down. According to the (Continued)

present invention, it is able to eliminate the shutdown after-image and prevent the occurrence of large shutdown current.

6 Claims, 5 Drawing Sheets

(52) U.S. Cl.
CPC ..... *G09G 2320/0257* (2013.01); *G09G 2330/025* (2013.01); *G09G 2330/027* (2013.01)

(56) References Cited

U.S. PATENT DOCUMENTS

| | | | |
|---|---|---|---|
| 2008/0170024 | A1 | 7/2008 | Song et al. |
| 2008/0291189 | A1 | 11/2008 | Song et al. |
| 2010/0026673 | A1 | 2/2010 | Cheng et al. |

FOREIGN PATENT DOCUMENTS

| | | | |
|---|---|---|---|
| CN | 101211036 | | 7/2008 |
| CN | 101217026 | A | 7/2008 |
| CN | 101271671 | A | 9/2008 |
| CN | 101667387 | A | 3/2010 |
| CN | 101673519 | A | 3/2010 |
| CN | 101739967 | A | 6/2010 |
| CN | 101919054 | A | 12/2010 |
| CN | 102279485 | A | 12/2011 |
| CN | 102290003 | A | 12/2011 |
| CN | 102621737 | A | 8/2012 |
| CN | 202390971 | U | 8/2012 |
| CN | 202483036 | U | 10/2012 |
| CN | 103033996 | A | 4/2013 |
| CN | 103207462 | A | 7/2013 |
| CN | 203049951 | U | 7/2013 |
| KR | 20110045520 | A | 5/2011 |
| TW | 201100877 | A | 1/2011 |

OTHER PUBLICATIONS

Chinese Office Action dated Dec. 3, 2014 regarding Chinese Application No. 201310311496.X. Translation provided by Dragon Intellectual Property Law Firm.
Office Action of Chinese application No. 201310373785.2, dated Aug. 3, 2015.
Written Opinion of the International Searching Authority for international application No. PCT/CN2013/089780.
European Search Report regarding Application No./Patent No. 13856065.1-1914 / 3026663 PCT/CN2013/083450, dated Feb. 1, 2017.

* cited by examiner

CIRCUIT AND METHOD FOR ELIMINATING SHUTDOWN AFTER-IMAGE, AND DISPLAY DEVICE

CROSS-REFERENCE TO RELATED APPLICATION

This application is the U.S. national phase of PCT Application No. PCT/CN2013/083450 filed on Sep. 13, 2013, which claims priority to Chinese Patent Application No. 201310311496.X filed on Jul. 23, 2013, the disclosures of which are incorporated in their entirety by reference herein.

TECHNICAL FIELD

The present invention relates to the field of display technology, in particular to a circuit and a method for eliminating a shutdown after-image, and a display device.

BACKGROUND

In order to eliminate a shutdown after-image, an existing thin film transistor liquid crystal display (TFT-LCD) has a function of turning on all TFTs at the moment of shutdown, i.e., an Xon function of turning on the TFTs in all rows when the TFT-LCD is shut down.

When the Xon function is enabled, an Xon signal will be decreased from a high level to a low level when it is detected that the liquid crystal display is shut down, and as shown in FIG. 1, all gate lines are turned on by a gate driving unit simultaneously. At this time, the higher a threshold voltage applied to the gate line, the more the charges on the gate line in each row and the more the current flowing through a signal line. In a process of arranging the gate driving unit on a TFT-LCD panel in a press-fit manner by using an anisotropic conductive film (ACF), after the gate driving unit is electrically coupled to the signal line of the TFT-LCD panel, some of Au particles (which serve as conductors) in the ACF are in a well-contact state while some are in a poor-contact state. In the case of few Au particles, the large current will pass through the Au particles in the well-contact state. When the TFT-LCD is shut down, if the instantaneous current on a gate signal line is too large, the current on the Au particles in the well-contact state will be large too. When the current exceeds the tolerance of the Au particles, some of the Au particles will be melted, and the instantaneous current will be withstood by the other Au particles. Upon repeated startup and shutdown, finally all the Au particles will be melted. As a result, TFTs cannot be turned on, and images will be displayed incorrectly.

In the prior art, the Xon function is usually achieved by a multi-level gate voltage (MLG) generated in a power IC. The MLG, which is used to apply a voltage to switch on a pixel TFT during the normal operation of the liquid crystal panel, is high and can lose its power rapidly (at a millisecond level) when the TFT-LCD is shut down. Within a short period of time, when the Xon function is enabled, it is difficult to ensure an appropriate value of the MLG. If the MLG is too high, the current passing through MLG lines in a peripheral gate-driving line (PLG) will be very large (larger than 200 mA) when all the gate lines are turned on. As a result, the Au particles on connection pins between a printed circuit board assembly (PCBA) and an X-chip on film (X-COF), between the X-COF and the panel, and between the panel and a Y-chip on film (Y-COF) will be burnt down easily. If the MLG is decreased too much (e.g., to 0V), the voltage for turning on the TFT will be too low when all the gate lines are turned on, and the charges on the pixels of the liquid crystal panel will not be aligned with each other rapidly. As a result, a shutdown after-image will occur.

SUMMARY

An object of embodiments of the present invention is to provide a circuit and a method for eliminating a shutdown after-image, and a display device, so as to eliminate the shutdown after-image and prevent the occurrence of large shutdown current.

In one aspect, an embodiment of the present invention provides a circuit for eliminating a shutdown after-image, comprising a control module configured to apply a common voltage of a liquid crystal panel to a gate line of the liquid crystal panel under the control of a shutdown signal when the liquid crystal panel is shut down.

The control module further comprises a first switch unit configured to output an MLG to the gate line during the operation of the liquid crystal panel and a second switch unit configured to output the common voltage to the gate line when the liquid crystal panel is shut down.

Further, the first switch unit is an N-type MOSFET, a gate electrode of the first switch unit is configured to receive the shutdown signal, a source electrode of the first switch unit is coupled to an MLG output end, and a drain electrode of the first switch unit is coupled to a voltage input end of the gate line. The second switch unit is a P-type MOSFET, a gate electrode of the second switch is configured to receive the shutdown signal, a source electrode of the second switch is coupled to the common voltage output end, and a drain electrode of the second switch is coupled to the voltage input end of the gate line.

The control module further comprises a third switch unit configured to supply power to a gate driving circuit by using the common voltage when the liquid crystal panel is shut down.

The third switch unit is a P-type MOSFET, a gate electrode of the third switch unit is configured to receive the shutdown signal, a source electrode of the third switch unit is coupled to the common voltage output end, and a drain electrode of the third switch unit is coupled to a power voltage input end of the gate driving circuit.

Further, the control module is arranged in a power IC or the gate driving circuit.

When the control module is arranged in the gate driving circuit, the control module further comprises a connection line arranged between the first switch unit and an MLG output end in the power IC, a connection line arranged between the second switch unit and a common voltage output end in the power IC, and a connection line arranged between the third switch unit and the common voltage output end in the power IC.

In another aspect, an embodiment of the present invention provides a display device comprising the above-mentioned circuit for eliminating a shutdown after-image.

In yet another aspect, an embodiment of the present invention provides a method for eliminating a shutdown after-image, comprising the step of applying a common voltage of a liquid crystal panel to a gate line of the liquid crystal panel under the control of a shutdown signal when the liquid crystal panel is shut down.

The step of applying a common voltage of a liquid crystal panel to a gate line of the liquid crystal panel under the control of a shutdown signal when the liquid crystal panel is shut down comprises outputting an MLG to the gate line during the operation of the liquid crystal panel, and outputting the common voltage to the gate line when the liquid crystal panel is shut down.

Further, an N-type MOSFET is arranged to output the MLG to the gate line during the operation of the liquid crystal panel. A gate electrode of the N-type MOSFET is configured to receive the shutdown signal, a source electrode of the N-type MOSFET is coupled to an MLG output end, and a drain electrode of the N-type MOSFET is coupled to a voltage input end of the gate line.

A first P-type MOSFET is arranged to output the common voltage to the gate line when the liquid crystal panel is shut down. A gate electrode of the first P-type MOSFET is configured to receive the shutdown signal, a source electrode of the first P-type MOSFET is coupled to the common voltage output end, and a drain electrode of the first P-type MOSFET is coupled to the voltage input end of the gate line.

The step of applying a common voltage of a liquid crystal panel to a gate line of the liquid crystal panel under the control of a shutdown signal when the liquid crystal panel is shut down further comprises supplying power to a gate driving circuit by using the common voltage when the liquid crystal panel is shut down.

Further, a second P-type MOSFET is arranged to supply power to the gate driving circuit by using the common voltage when the liquid crystal panel is shut down. A gate electrode of the second P-type MOSFET is configured to receive the shutdown signal, a source electrode of the second P-type MOSFET is coupled to the common voltage output end, and a drain electrode of the second P-type MOSFET is coupled to a power voltage input end of the gate driving circuit.

The present invention has the following advantages. When the liquid crystal panel is shut down, its common voltage is used to turn on all the gate lines simultaneously. Because the common voltage is low (its maximum value is about one-sixth of a maximum value of the MLG) and can lose its power slowly (at a second level) when the liquid crystal panel is shutdown, when the MLG is replaced with the common voltage to turn on the pixel TFT, it is able to effectively select a voltage ranged from 3V to 5V so as to ensure an on state of the TFT sufficient to rapidly align the charges on the pixels of the liquid crystal panel with each other, thereby to effectively eliminate the shutdown after-image. In addition, such a voltage ranged from 3V to 5V can prevent the occurrence of large shutdown current.

DETAILED DESCRIPTION

Figure 1:
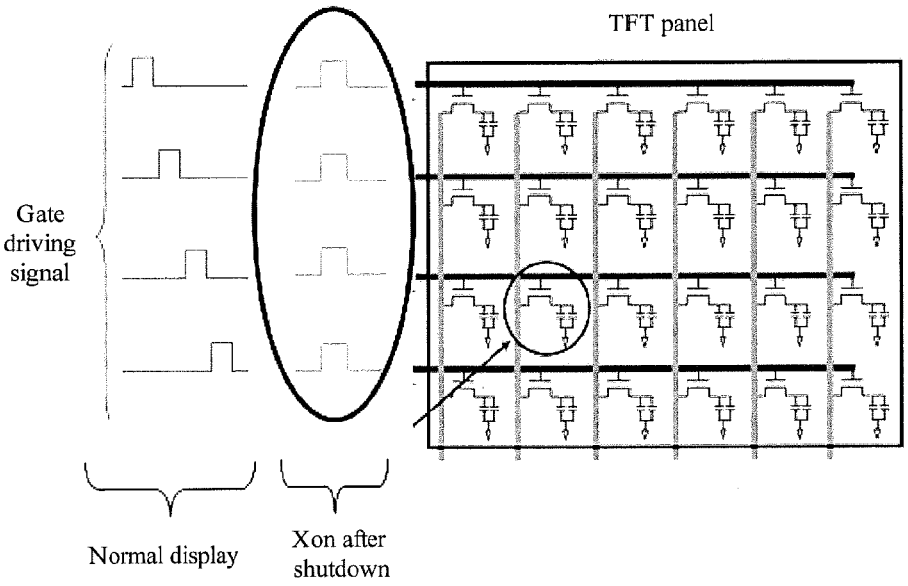
Prior Art Fig. 1
FIG. 1 is a sequence diagram of an Xon signal when an Xon function is enabled.

To make the objects, the technical solutions and the advantages of the present invention to be more apparent, the present invention will be described hereinafter in conjunction with the drawings and the embodiments.

In the prior art, an MLG is used to enable an Xon function, which however will result in a shutdown after-image and a large shutdown current. In order to eliminate the shutdown after-image and prevent the occurrence of the large shutdown current, embodiments of the present invention provide a circuit and a method for eliminating the shutdown after-image, and a display device.

An embodiment of the present invention provides a circuit for eliminating a shutdown after-image in a liquid crystal panel, comprising a control module configured to apply a common voltage of a liquid crystal panel to a gate line of the liquid crystal panel under the control of a shutdown signal when the liquid crystal panel is shut down.

The control module is specifically configured to apply an MLG of the liquid crystal panel to the gate line when the shutdown signal Xon is at a high level, and apply the common voltage of the liquid crystal panel to the gate line when the shutdown signal Xon is at a low level.

The control module may comprise a first switch unit configured to output the MLG to the gate line during the operation of the liquid crystal panel, and a second switch unit configured to output the common voltage to the gate line when the liquid crystal panel is shut down.

To be specific, the first switch unit is configured to couple the gate line with an MLG output end under the control of the shutdown signal Xon. The second switch unit is configured to couple the gate line with a common voltage Vcom output end under the control of the shutdown signal Xon.

The first switch unit may be an N-type MOSFET, a gate electrode of the first switch is configured to receive the shutdown signal Xon, a source electrode of the first switch is coupled to the MLG output end, and a drain electrode of the first switch is coupled to a voltage input end of the gate line. When the shutdown signal Xon is at a high level, the first switch unit controls the voltage input end of the gate line to be coupled to the MLG output end.

The second switch unit may be a P-type MOSFET, a gate electrode of the second switch is configured to receive the shutdown signal Xon, a source electrode of the second switch is coupled to the common voltage Vcom output end, and a drain electrode of the second switch is coupled to the voltage input end of the gate line. When the shutdown signal Xon is at a low level, the second switch unit controls the voltage input end of the gate line to be coupled to the common voltage Vcom output end.

As a result, when the liquid crystal panel is shut down, the common voltage Vcom may be used to turn on all the gate lines simultaneously. Because the common voltage Vcom is low and can lose its power slowly, when the MLG is replaced with the common voltage Vcom to turn on a pixel TFT, it is able to effectively select a voltage ranged from 3V to 5V so as to ensure an on state of the TFT sufficient to rapidly align charges on the pixels of the liquid crystal panel with each other, thereby to effectively eliminate the shutdown after-image. In addition, such a voltage ranged from 3V to 5V can also prevent the occurrence of large shutdown current.

In another embodiment, the control module may further comprise a third switch unit configured to supply power to a gate driving circuit by using the common voltage Vcom when the liquid crystal panel is shut down.

To be specific, the third switch unit is coupled to a power voltage (DVDDG) input end and the common voltage Vcom output end of the gate driving circuit, and configured to couple the DVDDG input end with the common voltage Vcom output end under the control of the shutdown signal Xon.

In the prior art, the DVDDG is used to supply power to the gate driving circuit, so as to ensure normal operation of the gate driving circuit. When the display is shut down, it is also required to ensure the normal operation of the gate driving circuit while enabling the Xon function, i.e., the DVDDG can still support the gate driving circuit to operate normally. However, an identical liquid crystal panel differs in different systems. When the Xon function is enabled, the DVDDG may have been decreased to a value insufficient to support the normal operation of the gate driving circuit, i.e., the gate driving circuit may have stopped working, so the Xon function cannot be achieved effectively. In order to solve this problem, in this embodiment, when the Xon function is enabled, the common voltage Vcom is used to apply a voltage to the gate driving circuit, so as to ensure that the gate driving circuit can still operate normally. A normal range of the DVDDG is from 2.6 to 3.3V, so the common voltage Vcom can fully meet the requirements of supplying power to the gate driving circuit. At this time, the power voltage of the gate driving circuit is DVDDG'.

To be specific, the third switch unit is a P-type MOSFET, a gate electrode of the third switch is configured to receive the shutdown signal Xon, a source electrode of the third switch is coupled to the common voltage Vcom output end, and a drain electrode of the third switch is coupled to a DVDDG' input end. When the shutdown signal Xon is at a low level, the third switch unit controls the DVDDG' input end to be coupled to the common voltage Vcom output end.

The circuit for eliminating the shutdown after-image will be described hereinafter in conjunction with the preferred embodiments and the drawings.

First Embodiment

The control module may be arranged in the power IC or the gate driving circuit. In this embodiment, the circuit for eliminating the shutdown after-image will be described by taking the control module arranged in the gate driving circuit as an example.

Figure 2:
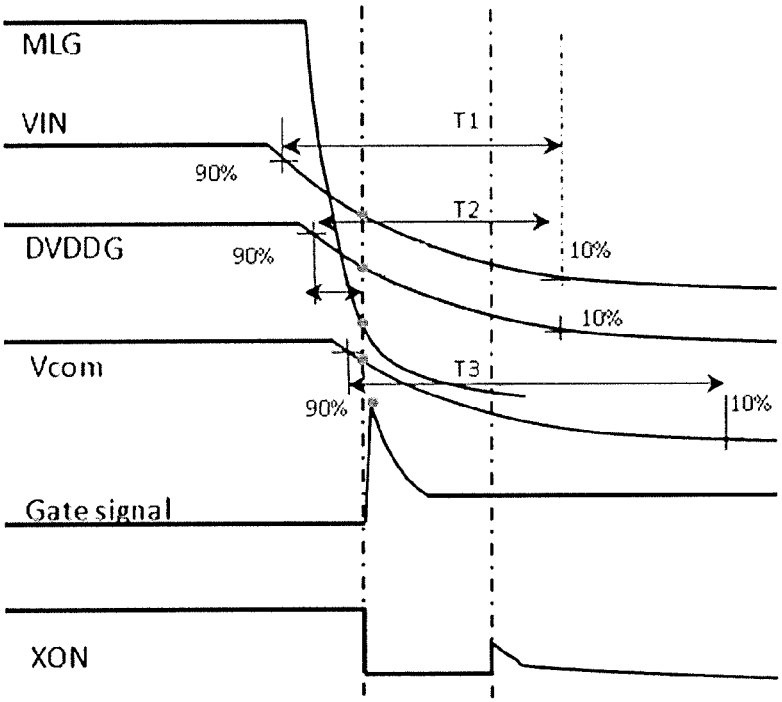
FIG. 2 is a sequence diagram of a signal when a liquid crystal panel is shut down.

FIG. 2 is a sequence diagram of a signal when the liquid crystal panel is shut down. When the liquid crystal panel is shut down, it will take less than 1 ms for the MLG to be decreased from 90% of the maximum value to 10%, about 50 ms (T1) for Vin (a gate input voltage) to be decreased from 90% of the maximum value to 10%, about 20 ms (T2) for the DVDDG to be decreased from 90% of the maximum value to 10% and about 600 ms (T3) for the common voltage Vcom to be decreased from 90% of the maximum value to 10%. In addition, when the liquid crystal panel is shut down, a gate signal will increase at first and then decrease, while the shutdown signal Xon will decrease at first, then increase and then return to zero.

In the prior art, the gate line is coupled to the MLG output end, and the MLG is selected and then output to the gate line at the moment that the shutdown signal Xon is changed from a high level to low level. However, as can be seen from FIG. 2, the MLG changes too rapidly, and it is uneasy to select a suitable voltage so as to eliminate the shutdown after-image and prevent the large shutdown current. If the selected MLG is too high, the current on the gate-driving peripheral lines will be large too (larger than 200 mA) when all the gate lines are turned on. As a result, Au particles on connection pins between a PCBA and an X-COF, between the X-COF and the panel, and between the panel and a Y-COF will easily be burnt down. If the MLG is decreased too much (e.g., to 0V), a voltage for turning on the TFT will be too low when all the gate lines are turned on, and the charges on the pixels of the liquid crystal panel will not be aligned with each other rapidly. As a result, a shutdown after-image will occur.

As can be seen from FIG. 2, the common voltage Vcom will lose its power slowly. As a result, when the common voltage Vcom is used to turn on the gate lines, there is no stringent requirement on the signal sequence, and it is easy to eliminate the shutdown after-image and prevent the large shutdown current (<200 mA). Hence, for the circuit comprising the control module controlled by the shutdown signal Xon in this embodiment, when the liquid crystal panel operates normally and the shutdown signal Xon is at a high level, the voltage input end of the gate line is coupled to the MLG output end, and when the liquid crystal panel is shut down and the shutdown signal Xon is at a low level, the voltage input end of the gate line is disconnected to the MLG output end, and the voltage input end of the gate line is coupled to the common voltage Vcom output end.

In this embodiment, the control module is arranged in the gate driving circuit. The control module comprises the first switch unit coupled with the voltage input end of the gate line and the MLG output end, and the second switch unit coupled with the voltage input end of the gate line and the common voltage Vcom output end. The first switch unit is configured to couple the voltage input end of the gate line with the MLG output end when Xon is at a high level, and break off the connection between the voltage input of the gate line and the MLG output when Xon is at a low level. The second switch unit is configured to break off the connection between the voltage input end of the gate line and the common voltage Vcom output end when Xon is at a high level and couple the voltage input end of the gate line with the common voltage Vcom output end when Xon is at a low level.

Further, in order to ensure that the gate driving circuit can still operate normally when the Xon function is enabled, in this embodiment the common voltage Vcom is used to apply a voltage to the gate driving circuit. The control module further comprises a third switch unit coupled with the DVDDG' input end and the common voltage Vcom output end. The third switch unit is configured to break off the connection between the DVDDG' input end and the common voltage Vcom output end when Xon is at a high level, and couple the DVDDG' input end with the common voltage Vcom output end when Xon is at a low level.

Figure 3:
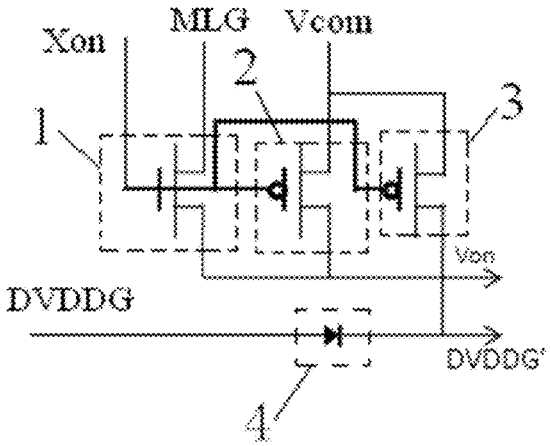
FIG. 3 is a schematic view showing a control module according to a first embodiment of the present invention.
Figure 4:
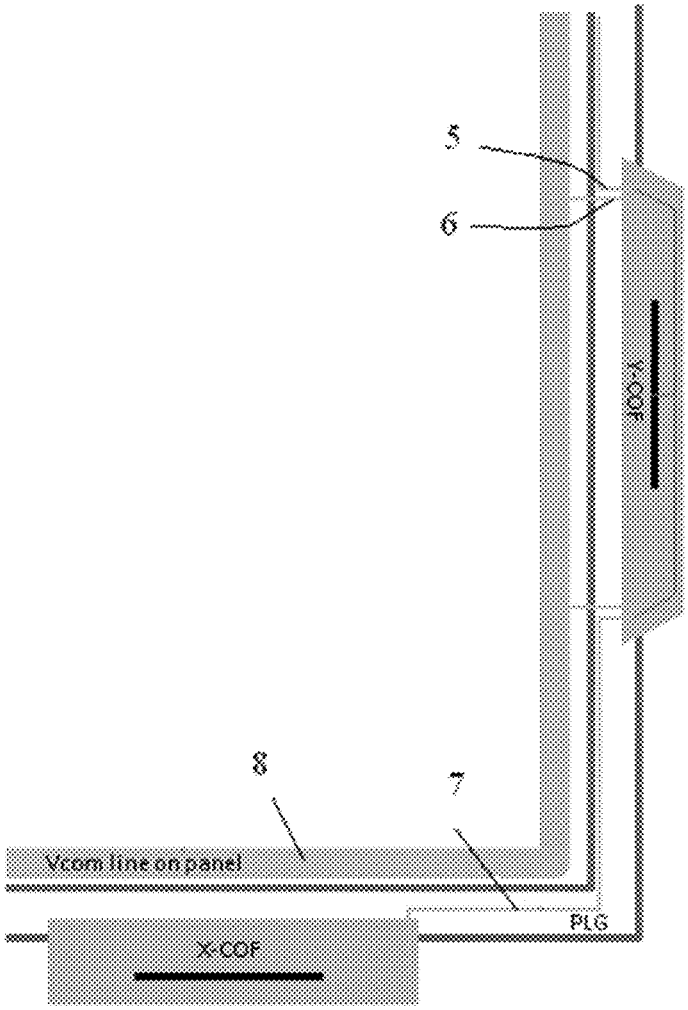
FIG. 4 is a schematic view showing peripheral lines of the control module according to the first embodiment of the present invention.

As shown in FIGS. 3 and 4, the first switch unit 1 may be an N-type MOSFET, the gate electrode of the first switch unit 1 is configured to receive the shutdown signal Xon, the source electrode of the first switch unit 1 is coupled to the MLG output end, and the drain electrode of the first switch unit 1 is coupled to the voltage input end of the gate line (i.e., Von input end in FIG. 3). The second switch unit 2 may be a P-type MOSFET, the gate electrode of the second switch unit 2 is configured to receive the shutdown signal Xon, the source electrode of the second switch unit 2 is coupled to the common voltage Vcom output end, and the drain electrode of the second switch unit 2 is coupled to the Von input end. The third switch unit 3 may be a P-type MOSFET, the gate electrode of the third switch unit 3 is configured to receive the shutdown signal Xon, the source electrode of the third switch unit 3 is coupled to the common voltage Vcom output end, and the drain electrode of the third switch unit 3 is coupled to the DVDDG' input end.

Because the control module is arranged in the gate driving circuit while the common voltage Vcom output circuit and the MLG circuit are arranged in the power IC, the control module further comprises a connection line arranged between the first switch unit and the MLG circuit in the power IC, a connection line arranged between the second switch unit and the common voltage Vcom output circuit in the power IC, and a connection line arranged between the third switch unit and the common voltage Vcom output circuit in the power IC.

In the liquid crystal panel as shown in FIG. 4, a PLG line 5 coupled between the gate driving circuits at side Y transmits a gate driving controlling signal including Xon. The gate driving circuit is coupled to a common voltage line 8 within the panel via a line 6 of a bonding pin. All the common voltage lines 8 within the entire panel are coupled together to form a big capacitor. Line 7 is a PLG line connecting an X-COF and a Y-COF and transmits the gate driving control signals including MLG, DVDDG/DVDDG' and Xon.

Further, in this embodiment, a unilaterally-conducting diode 4 is provided between the DVDDG' output end and the original power voltage DVDDG end of the gate driving circuit, so as to prevent the common voltage from driving the power IC on a PCBA to get back to work after the liquid crystal panel is shut down.

In this embodiment, if the Xon function is enabled, Xon and DVDDG' are both disconnected to Vcom when the panel operates normally and Xon is at a high level, while Xon and DVDDG' are both coupled to Vcom when the panel is shut down and Xon is changed from a high level to a low level. Vcom supplies power to the gate driving circuit and turns on all the gate lines, so as to eliminate the shutdown after-image. The common voltage Vcom is low (3-5V) and can lose its power slowly (at a second level). Such a voltage of 3-5V can ensure an on state of the TFT sufficient to rapidly align the charges on the pixels of the liquid crystal panel with each other, thereby to eliminate the shutdown after-image. Meanwhile, when all the gate lines are charged by such a voltage of 3-5V, the total current is less than 200 mA. Moreover, two channels may be provided at each Y-COF conveniently so that the current from the common electrode of the panel can pass therethrough. So, the current passing through each channel will be smaller. As calculated on the basis of six channels, the current is one sixth of the maximum channel current in the prior art. As a result, it is able to prevent the occurrence of the large shutdown current.

Second Embodiment

The control module may be arranged in the power IC or the gate driving circuit. In this embodiment, the circuit for eliminating the shutdown after-image will be described by taking the control module arranged in the power IC as an example.

Figure 5:
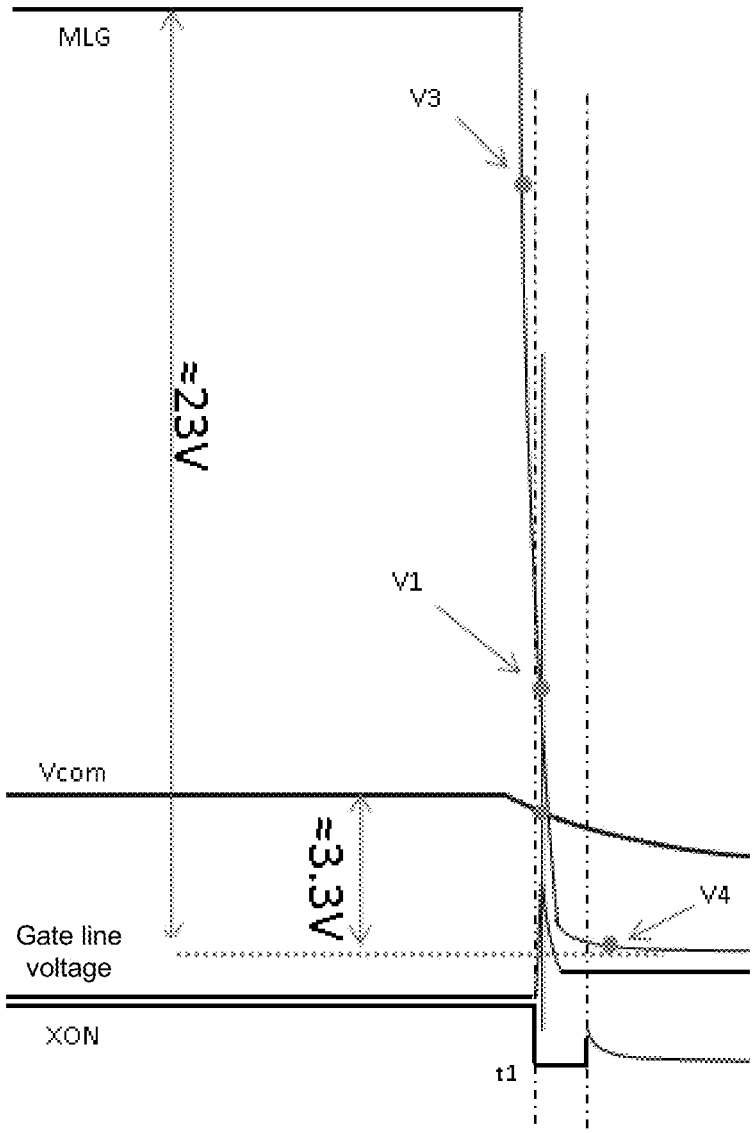
FIG. 5 is a sequence diagram of an MLG, a voltage Vcom and the Xon signal when the liquid crystal panel is shut down.

In the prior art, the gate line is coupled to the MLG output end, and the MLG is selected and then output to the voltage input end of the gate line at the moment that the shutdown signal Xon is changed from a high level to a low level. As shown in FIG. 5, the MLG is high (22V-27V), and the time for losing its power when the panel is shut down is short (less than 1 ms). The Xon function is enabled at time t1. If at this time the MLG is V1 or a value in the vicinity of V1, the large shutdown current and the shutdown after-image will not occur. If the MLG is a value in the vicinity of V3, the large shutdown current will occur. If the MLG is a value in the vicinity of V4, the on state of the pixel TFT will be non-ideal and the charges on the pixels will be released slowly, so the shutdown after-image will occur. It can therefore be seen that, when the Xon function is enabled, it is very difficult to ensure the selection of a suitable MLG.

However, Vcom is in a range from 3V to 5V, and if such a voltage is used to turn on all the gate lines, the large shutdown current will not occur, and it is able to prevent Au particle in a bonding area from being burnt down. In addition, Vcom will lose its power slowly (at a second level) when the panel is shut down, and even for different systems, there is a relative great difference in the sequences of enabling the Xon function, so it is able to ensure that a voltage slightly lower than Vcom is applied onto the pixel TFT when the Xon function is enabled, and to ensure an on state of the pixel TFT sufficient to release the charges on the pixels uniformly, thereby to eliminate the shutdown after-image. Hence, in this embodiment, a circuit for eliminating a shutdown after-image is provided. When the panel is shut down, Vcom is used to turn on the gate lines. The circuit comprises the control module controlled by the shutdown signal Xon, so as to connect the voltage input end of the gate line and the MLG output end when the liquid crystal panel operates normally and Xon is at a high level, and to break off the connection between the voltage input end of the gate line and the MLG output end and connect the voltage input end of the gate line and the common voltage Vcom output end when the liquid crystal panel is shut down and Xon is at a low level.

Figure 6:
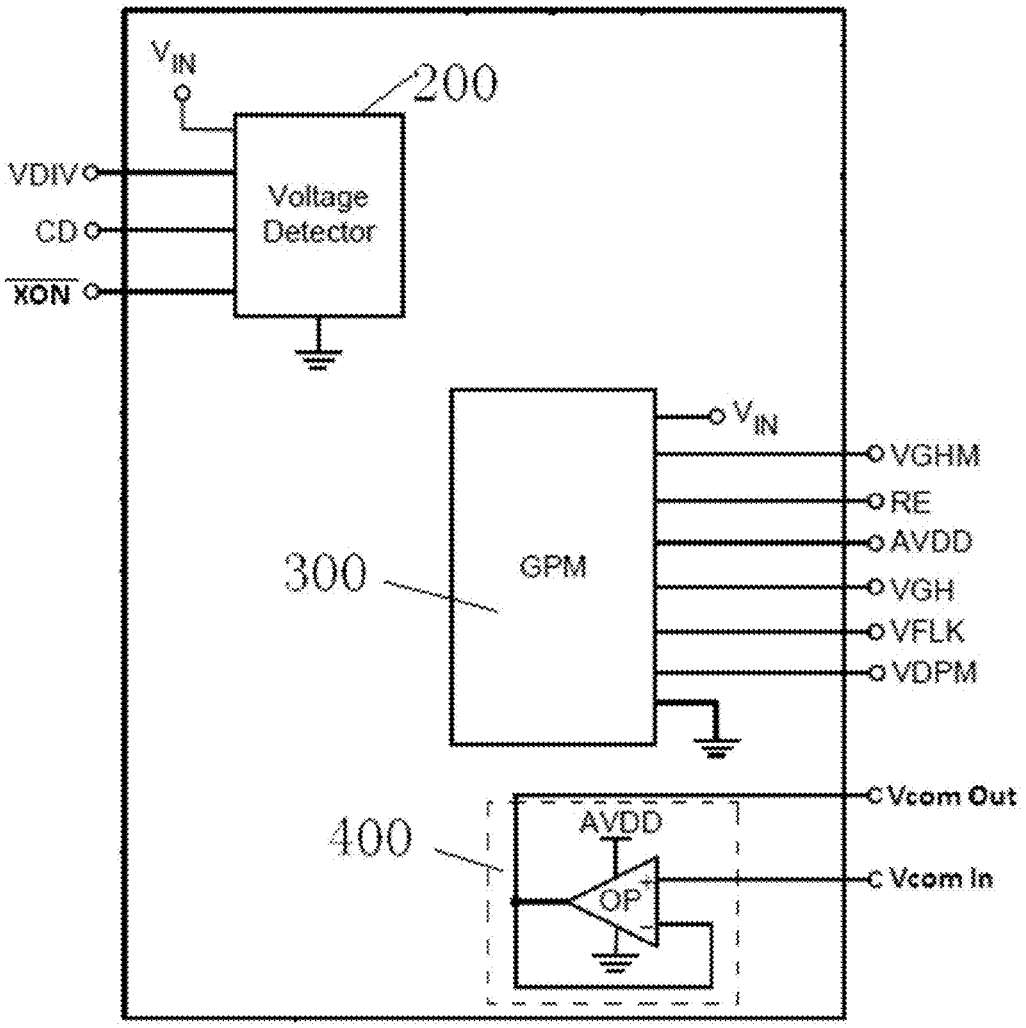
FIG. 6 is a schematic view showing an existing power IC.
Figure 7:
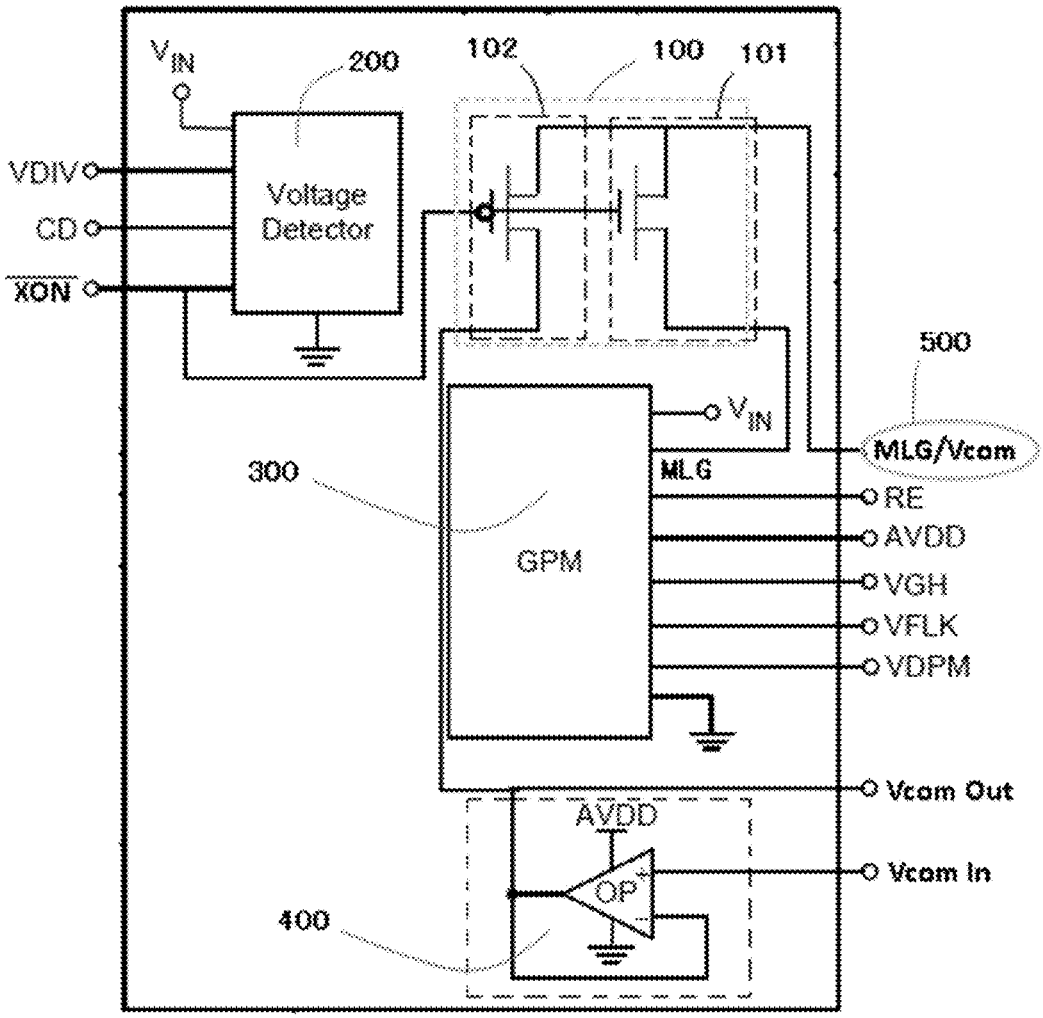
FIG. 7 is a schematic view showing a power IC according to a second embodiment of the present invention.

In this embodiment, the control module is arranged in the power IC. FIG. 6 is a schematic view showing an existing power IC, and FIG. 7 is a schematic view showing the power IC added with the control module. Modules 200, 300 and 400 are common modules in the existing power IC. The module 200, as a voltage detector, has a function of detecting an external power supply, and the shutdown signal Xon is changed from a high level to a low level when it is detected by the module 200 that the liquid crystal panel is shut down. The module 300 (GPM) is an MLG generation module for applying a voltage to turn on the TFT when the liquid crystal panel operates normally. The module 400 is a Vcom signal power amplifier for increasing the driving capability of Vcom. The module 100 is the control module of this embodiment, and has a selection function of selectively applying the MLG generated by the module 300 and Vcom generated by module 400 to an output end 500 under the control of the shutdown signal Xon from the module 200. When Xon is at a high level, the output end 500 outputs MLG, and when Xon is at a low level, the output 500 end outputs Vcom. The output end 500 is coupled to the gate line to output the MLG/Vcom signals.

To be specific, the control module comprises the first switch unit 101 connecting the output end 500 and the module 300, so as to output the MLG generated by the module 300 to the output end 500 when Xon is at a high level and not to output the MLG generated by the module 300 to the output end 500 when Xon is at a low level. The control module further comprises the second switch unit 102 connecting the output end 500 and the module 400, so as not to output the common voltage Vcom generated by the module 400 to the output end 500 when Xon is at a high level and to output the common voltage Vcom generated by the module 400 to the output end 500 when Xon is at a low level.

The first switch unit may be an N-type MOSFET, the gate electrode of the first switch unit is configured to receive the shutdown signal Xon, the source electrode of the first switch unit is coupled to the MLG output end, and the drain electrode of the first switch unit is coupled to the gate line. The second switch unit may be a P-type MOSFET, the gate electrode of the second switch unit is configured to receive the shutdown signal Xon, the source electrode of the second switch unit is coupled to the common voltage Vcom output end, and the drain electrode of the second switch unit is coupled to the gate line.

In addition, in this embodiment, the control module may further comprise a third switch unit (not shown) coupled with the DVDDG' input end and the common voltage Vcom output end. The third switch unit is configured to break off the connection between the DVDDG' input end and the common voltage Vcom output end when Xon is at a high level, and to connect the DVDDG' input end and the common voltage Vcom output end when Xon is at a low level, thereby to ensure that the gate driving circuit can still operate normally when the Xon function is enabled. The third switch unit may be an N-type MOSFET, the gate electrode of the third switch unit is configured to receive the shutdown signal Xon, the source electrode of the third switch unit is coupled to the common voltage Vcom output end, and the drain electrode of the third switch unit is coupled to the DVDDG' input end.

In this embodiment, if the Xon function is enabled, the gate line is disconnected to the common voltage Vcom output end when the panel operates normally and Xon is at a high level, and the gate line is coupled to the common voltage Vcom output end when the panel is shut down and Xon is changed from the high level to a low level, so that the common voltage can turn on all the gate lines and eliminate the shutdown after-image. The common voltage is low (3V-5V) and can lose its power slowly (at a second level). Such a voltage ranged from 3V to 5V ensures an on state of the TFT sufficient to rapidly align the charges on the pixels of the liquid crystal panel with each other, thereby to eliminate the shutdown after-image. Meanwhile, when all the gate lines are charged by such a voltage ranged from 3V to 5V, the total current is less than 200 mA, thereby it is able to prevent the large shutdown current.

The present invention further provides a display device comprising the above-mentioned circuit for eliminating the shutdown after-image. The structures and the working principle of the circuit are mentioned hereinabove and will not be repeated herein. In addition, the structures of the other members of the display device may refer to those in the prior art and will not be repeated herein too. The display device may be any product or component having a display function such as a liquid crystal panel, an electronic paper, an OLED panel, a liquid crystal TV, a liquid crystal display, a digital photo frame, a mobile phone and a tablet PC.

The above are merely the preferred embodiments of the present invention. It should be noted that, a person skilled in the art may make further improvements and modifications without departing from the principle of the present invention, and these improvements and modifications shall also be considered as the scope of the present invention.

What is claimed is:

1. A circuit for eliminating a shutdown after-image, comprising:

a control module, configured to apply a common voltage of a liquid crystal panel to a gate line of the liquid crystal panel under control of a shutdown signal when the liquid crystal panel is shut down;

wherein the control module comprises:

a first switch unit, configured to output a multi-level gate voltage MLG to the gate line during operation of the liquid crystal panel; and a second switch unit, configured to output the common voltage to the gate line when the liquid crystal panel is shut down; and a third switch unit, configured to supply power to a gate driving circuit by using the common voltage when the liquid crystal panel is shut down;

wherein the first switch unit is an N-type MOSFET, a gate electrode of the first switch unit is configured to receive the shutdown signal, a source electrode of the first switch unit is coupled to an MLG output end, and a drain electrode of the first switch unit is coupled to a voltage input end of the gate line;

wherein the second switch unit is a P-type MOSFET, a gate electrode of the second switch unit is configured to receive the shutdown signal, a source electrode of the second switch unit is coupled to a common voltage output end, and a drain electrode of the second switch unit is coupled to a voltage input end of the gate line; and wherein the third switch unit is a P-type MOSFET, a gate electrode of the third switch unit is configured to receive the shutdown signal, the gate electrode of the third switch unit is coupled to the gate electrode of the first switch unit and the gate electrode of the second switch unit, a source electrode of the third switch unit is coupled to the common voltage output end, and a drain electrode of the third switch unit is coupled to a power voltage input end of the gate driving circuit.

2. The circuit according to claim 1, wherein the control module is arranged in a power IC or the gate driving circuit.

3. The circuit according to claim 2, wherein when the control module is arranged in the gate driving circuit, the control module further comprises:

a connection line arranged between the first switch unit and an MLG output end in the power IC;

a connection line arranged between the second switch unit and a common voltage output end in the power IC; and a connection line arranged between the third switch unit and the common voltage output end in the power IC.

4. A display device comprising the circuit for eliminating a shutdown after-image according to claim 1.

5. A method for eliminating a shutdown after-image, comprising:

applying a common voltage of a liquid crystal panel to a gate line of the liquid crystal panel under control of a shutdown signal when the liquid crystal panel is shut down;

outputting a multi-level gate voltage MLG to the gate line during operation of the liquid crystal panel; and outputting the common voltage to the gate line when the liquid crystal panel is shut down;

wherein an N-type MOSFET is arranged to output the MLG to the gate line during the operation of the liquid crystal panel, a gate electrode of the N-type MOSFET is configured to receive the shutdown signal, a source electrode of the N-type MOSFET is coupled to an MLG output end, and a drain electrode of the N-type MOSFET is coupled to a voltage input end of the gate line;

wherein a first P-type MOSFET is arranged to output the common voltage to the gate line when the liquid crystal panel is shut down, a gate electrode of the first P-type MOSFET is configured to receive the shutdown signal, a source electrode of the first P-type MOSFET is coupled to a common voltage output end, and a drain electrode of the first P-type MOSFET is coupled to a voltage input end of the gate line; and wherein a second P-type MOSFET is arranged to supply power to the gate driving circuit by using the common voltage when the liquid crystal panel is shut down, a gate electrode of the second P-type MOSFET is configured to receive the shutdown signal, the gate electrode of the second P-type MOSFET is coupled to the gate electrode of the N-type MOSFET and the gate electrode of the first P-type MOSFET, a source electrode of the second P-type MOSFET is coupled to the common voltage output end, and a drain electrode of the second P-type MOSFET is coupled to a power voltage input end of the gate driving circuit.

6. The method according to claim 5, wherein the step of applying the common voltage of the liquid crystal panel to the gate line of the liquid crystal panel under the control of the shutdown signal when the liquid crystal panel is shut down further comprises:

supplying power to a gate driving circuit by using the common voltage when the liquid crystal panel is shut down.

* * * * *